US006984942B2

(12) United States Patent
Siegfried et al.

(10) Patent No.: US 6,984,942 B2
(45) Date of Patent: Jan. 10, 2006

(54) LONGITUDINAL CATHODE EXPANSION IN AN ION SOURCE

(75) Inventors: Daniel E. Siegfried, Fort Collins, CO (US); David Matthew Burtner, Fort Collins, CO (US); Scott A. Townsend, Fort Collins, CO (US); John Keem, Bloomfield Hills, MI (US); Valery Alexeyev, Moscow (RU); Vsevolod Zelenkov, Moscow (RU); Mark Krivoruchko, Zelenograd (RU)

(73) Assignee: Veeco Instruments, Inc., Woodbury, NY (US)

( * ) Notice: Subject to any disclaimer, the term of this patent is extended or adjusted under 35 U.S.C. 154(b) by 0 days.

(21) Appl. No.: 10/896,745

(22) Filed: Jul. 21, 2004

(65) Prior Publication Data

US 2005/0057166 A1 Mar. 17, 2005

Related U.S. Application Data

(60) Provisional application No. 60/489,357, filed on Jul. 22, 2003.

(51) Int. Cl.
*H01J 7/24* (2006.01)

(52) U.S. Cl. ..... 315/111.81; 250/423 R

(58) Field of Classification Search ..... 315/111.81, 315/111.91; 250/423 R, 426; 438/961
See application file for complete search history.

(56) References Cited

U.S. PATENT DOCUMENTS

| | | | | |
|---|---|---|---|---|
| 5,763,989 | A | 6/1998 | Kaufman | 315/111.41 |
| 5,945,781 | A * | 8/1999 | Valentian | 315/111.81 |
| 6,002,208 | A | 12/1999 | Maishev | 315/111.91 |
| 6,037,717 | A | 3/2000 | Maishev | 315/111.91 |
| 6,130,507 | A | 10/2000 | Maishev | 315/111.81 |
| 6,147,354 | A | 11/2000 | Maishev | 250/423 R |
| 6,153,067 | A | 11/2000 | Maishev | 204/298.04 |
| 6,214,183 | B1 | 4/2001 | Maishev | 204/298.04 |
| 6,236,163 | B1 | 5/2001 | Maishev | 315/111.81 |
| 6,238,526 | B1 | 5/2001 | Maishev | 204/192.11 |
| 6,242,749 | B1 | 6/2001 | Maishev | 250/423 R |
| 6,246,059 | B1 | 6/2001 | Maishev | 250/426 |
| 6,250,250 | B1 | 6/2001 | Maishev | 118/723 ER |
| 6,359,388 | B1 | 3/2002 | Petrmichl | 315/111.81 |
| 6,368,664 | B1 | 4/2002 | Veerasamy | 427/249.7 |

(Continued)

OTHER PUBLICATIONS

Dr. John Keem, High Current Density Anode Layer Ion Sources, 44th Annual Technical Conference Proceedings, 2001, pp. 1-6, Society of Vacuum Coaters.

(Continued)

*Primary Examiner*—Wilson Lee
*Assistant Examiner*—Ephrem Alemu
(74) *Attorney, Agent, or Firm*—Hensley Kim & Edgington LLC

(57) ABSTRACT

An ion source design and manufacturing techniques allows longitudinal cathode expansion along the length of the anode layer source (ALS). Cathode covers are used to secure the cathode plates to the source body assembly of an ion source. The cathode covers allow the cathode plate to expand along the longitudinal axis of the ion source, thereby relieving the stress introduced by differential thermal expansion. In addition, the cathode cover configuration allows for less expensive cathode plates, including modular cathode plates. Such plates can be adjusted relative to the cathode-cathode gap to prolong the life of a given cathode plate and maintain source performance requirements. A cathode plate in a linear section of an ion source has symmetrical edges and can, therefore, be flipped over to exchange the first (worn) cathode edge with the second (unworn) cathode edge.

16 Claims, 7 Drawing Sheets

U.S. PATENT DOCUMENTS

| | | | | |
|---|---|---|---|---|
| 6,454,901 | B1 | 9/2002 | Sekiya | 162/111 |
| 6,454,910 | B1 | 9/2002 | Zhurin | 204/192.12 |
| 6,750,600 | B2 * | 6/2004 | Kaufman et al. | 315/111.81 |
| 6,777,030 | B2 | 8/2004 | Veerasamy | 427/249.7 |
| 6,808,606 | B2 | 10/2004 | Thomsen | 204/192.3 |
| 6,815,690 | B2 | 11/2004 | Veerasamy et al. | 315/111.81 |
| 2004/0195521 | A1 * | 10/2004 | Alekseev et al. | 250/423 R |

OTHER PUBLICATIONS

D. Burtner, Linear Anode-Layer Ion Sources With 340- and 1500-mm Beams, 46th Annual Technical Conference Proceedings, May 2003, pp. 61-66, Society of Vacuum Coaters.

V. Dudnikov, Ion Source With Closed Drift Anode Layer Plasma Acceleration, Review of Scientific Instruments, Feb. 2002, pp. 729-731, vol. 73 No. 2, American Institute of Physics.

V. Zhurin, Physics of Closed Drift Thrusters, Plasma Sources Sci. Technol. 8, 1999, pp. R1-R20, IOP Publishing Ltd., UK.

N. Vershinin, Hall Current Accelerator For Pre-Treatment of Large Area Glass Sheets, Coatings on Glass, 1999, pp. 283-286.

V. Baranov, Energy Model and Mechanisms of Acceleration Layer Formation For Hall Thrusters, 33rd Joint Propulsion Conference, Jul. 1997, pp. 1-8, AIAA 97-3047, Reston, VA.

A. Zharinov, Acceleration of Plasma by a Closed Hall Current, Soviet Physics—Technical Physics, Aug. 1967, pp. 208-211, vol. 12 No. 2, Russia.

A. Semenkin, Investigation of Erosion in Anode Layer Thrusters and Elaboration High Life Design Scheme, 23rd Intl Electric Propulsion Conf., Sep. 1993, pp. 1-6, IEPC-93-231.

L. Lou, Application Note: Ion Source Precleaning, Advanced Energy, Mar. 2001, pp. 1-4, Fort Collins, CO.

Plasma Surface Engineering Corporation, Compound Ion Beam-Magnetron Sputtering Source, Product Specification: I-Mag, Feb. 2003, pp. 1-5, San Diego, CA.

A. Shabalin, Whitepaper: Industrial Ion Sources and Their Application for DLC Coating, SVC 42nd Annual Technical Conference, Jan. 2001, pp. 1-4, Fort Collins, CO.

Advanced Energy, Ion Beam Sources, [online], Aug. 2002, [retrieved on Dec. 6, 2004], Retrieved from the Advanced Energy company website using Internet <URL: http://www.advanced-energy.com/upload/sl-ion-230-02.pdf>, pp. 1-6, Fort Collins, CO.

VECOR, Vacuum Equipment Coatings and Optics from Russia, [online], last updated on Apr. 22, 2004, [retrieved on Dec. 6, 2004], Retrieved from the Advanced Energy company website using Internet <URL: http://www.vecorus.com/welcom.htm>, Moscow, Russia.

VECOR, Vacuum Equipment Coatings and Optics from Russia, Magnetrons Ion Sources and Accessories, [online], last updated on Apr. 22, 2004, [retrieved on Dec. 6, 2004], Retrieved from the Advanced Energy company website using Internet <URL: http://www.vecorus.com/magionsource.htm>, Moscow, Russia.

* cited by examiner

LONGITUDINAL CATHODE EXPANSION IN AN ION SOURCE

RELATED APPLICATIONS

This application claims benefit of U.S. Provisional Application No. 60/489,357 entitled "Modular Anode Layer Source Allowing Uni-directional Cathode Expansion" and filed on Jul. 22, 2003, incorporated herein by reference for all that it discloses and teaches.

In addition, this application relates to U.S. patent application Ser. No. 10/896,746 entitled "Modular Ion Source" and U.S. patent application Ser. No. 10/896,747 entitled "Modular Uniform Gas Distribution System in an Ion Source", both filed on Jul. 21, 2004 and incorporated herein by reference for all that they disclose and teach.

TECHNICAL FIELD

The invention relates generally to ion sources, and more particularly to cathode expansion in an ion source.

BACKGROUND

Anode Layer Sources (ALSs) produce and accelerate ions from a thin and intense plasma called the "anode layer". This anode layer forms adjacent to an anode surface of an ALS due to large Hall currents, which are generated by the interaction of strong crossed electric and magnetic fields in the plasma discharge (gap) region. This plasma discharge region is defined by the magnetic field gap between cathode pole pieces (also called the "cathode-cathode gap") and the electric field gap between the downstream surface of the anode and the upstream surface of the cathode (also called the "anode-cathode gap"). A working gas, including without limitation a noble gas, oxygen, or nitrogen, is injected into the plasma discharge region and ionized to form the plasma. The electric field accelerates the ions away from the plasma discharge region toward a substrate.

In one implementation of a linear ALS, the anode layer forms a continuous, closed path exposed along a race-track-shaped ionization channel in the face of the ion source. Ions from the plasma are accelerated primarily in a direction normal to the anode surface, such that they form an ion beam directed roughly perpendicular to the ionization channel and the face of the ion source. Different ionization channel shapes may also be employed.

For typical etching or surface modification processes, a substrate (such as a sheet of flat glass) is translated through the ion beam in a direction perpendicular to the longer, straight sections of the ionization channel. Uniform etching across the substrate, therefore, depends on the ion beam flux and energy density being uniform along the length of these straight channel sections. Variations in the ion beam flux and energy density uniformity along the straight channel sections can significantly degrade the longitudinal uniformity of the resulting ion beam.

Non-uniformities in the anode-cathode gap can have a significant negative effect on the longitudinal ion beam uniformity and can be introduced in various ways during manufacturing. For example, the ion source body can be warped by the welding or brazing of a cooling tube to the outside surface of the ion source body, thus introducing anode-cathode gap variations.

Minor gap variations can result in substantial longitudinal beam current density variations. A typical ALS geometry has an anode-cathode gap of 2 mm, a cathode-cathode gap of 2 mm, and a cathode face height of 2 mm, which is also known as a 2×2×2 mm geometry. Measurements of a linear ALS using this geometry have shown that variations of 0.3 mm in the anode-cathode gap dimension can cause longitudinal beam current density variations of 8%. It should be understood that alternative ALS configurations and dimensions may also be employed. Non-uniformities in the cathode-cathode gap and the working gas distribution to the anode layer can also negatively influence ion beam uniformity.

A typical ALS design includes a rigid monolithic anode supported on insulators in a cavity of a rigid monolithic source body. Both the anode and the source body are cut from stainless steel stock and are precisely machined to the desired dimensions. Rough machining and welding-induced or brazing-induced distortion during assembly often dictate that the flat surfaces of the source body and anode undergo a final precision machining operation in order to hold the desired gap dimension tolerance.

This manufacturing process has provided good results for relatively short ion sources (e.g., 300 mm long). However, some ALS applications can require very long ion sources (e.g., 2540 mm to 3210 mm). For example, some architectural glass processing applications can require an ALS that is about twelve feet long (i.e., 3657.6 mm). Such length can make it extremely difficult and prohibitively expensive to maintain the required uniformity of the anode-cathode gap over the entire length of the ALS. Therefore, using traditional monolithic designs and manufacturing techniques for long ALSs is undesirable and potentially infeasible.

Differential thermal expansion of a cathode plate during operation is a particular problem with long linear ion sources. The inner edge of the cathode plate is directly exposed to a very intense plasma discharge and operates at a very high temperature, whereas the outer edge or region of the cathode plate, which is in direct contact with a water-cooled surface, operates at a significantly lower temperature. The temperature difference between the inner edge and the outer edge/region of a cathode plate can introduce a variety of problems in ion source operation, including non-uniformities in the ion beam and damage to the cathode and the attachment bolts that secure the cathode to the source body.

In addition, cathodes are traditionally precision machined out of thick stainless steel stock, which makes a cathode an expensive component. To compound this expense, operation of the ion source results in substantial wearing of the inner edge of each cathode plate, which can degrade the uniformity of the cathode face height, the cathode-cathode gap, the anode-cathode gap, and the electric and magnetic fields in the gap. Accordingly, such cathode wear necessitates frequent replacement of cathode plates during the life of the ion source.

SUMMARY

Implementations described and claimed herein address the foregoing problems by providing an ion source design and ion source manufacturing techniques that allow longitudinal cathode expansion along the length of the anode layer source (ALS). In one implementation, instead of screwing thick, precision machined cathode plates to the source body and magnet covers, cathode covers are used to secure the cathode plates to the source body and magnet covers of an ion source. The cathode covers allow the cathode plate to expand along the longitudinal axis of the ion source, thereby relieving the stress introduced by differential thermal expansion, while constraining lateral movement of the cathode plate.

In addition, the cathode cover configuration allows for less expensive cathode plates, including modular cathode plates. Such plates can be adjusted to control the cathode-cathode gap, which prolongs the life of a given cathode plate. In one implementation, a cathode plate in a linear section of a cathode has symmetrical edges and can, therefore, be flipped over to exchange the first (worn) cathode edge with the second (unworn) cathode edge.

In one implementation, a method of assembling an ion source is provided. A source body assembly is assembled. An anode assembly is mounted within the source body assembly. Two or more cathode plates are positioned relative to the anode assembly to form an anode-cathode gap and a cathode-cathode gap. At least one of the cathode plates forms the outside edge of the cathode-cathode gap and includes one or more elongated pin slots and one or more enlarged attachment holes. A pin of a cathode cover is inserted into one of the elongated pin slots of the at least one of the cathode plates. The cathode cover is mounted to the source body assembly using a fastener inserted through one of the enlarged attachment holes of the cathode and into the source body assembly.

In another implementation, a method maintains an ion source. A cathode cover is removed from an ion source assembly including at least one cathode plate having a worn edge and an unworn edge, the worn edge having been worn as an edge of a cathode-cathode gap in the ion source during operation of the ion source. The cathode plate is removed from the ion source assembly and then re-mounted the cathode plate to the ion source assembly such that the unworn edge forms the edge of the cathode-cathode gap in the ion source.

In another implementation, a method maintains an ion source having a cathode plate positioned against a source body. Attachment fasteners securing a cathode cover module and the cathode plate to the source body are loosened. The cathode cover module is in laterally fixed alignment with the cathode plate. One or more adjustable screws positioned along the length of the cathode cover are adjusted to reset a specified cathode-cathode gap dimension in the ion source. The attachment fasteners are tightened to re-secure the cathode cover module and the cathode plate to the source body.

In another implementation, an ion source having a source body includes a cathode plate having a working edge positioned along a side of a cathode-cathode gap; and a cathode cover securing the cathode plate against the source body.

Other implementations are also described and recited herein.

BRIEF DESCRIPTIONS OF THE DRAWINGS

DETAILED DESCRIPTIONS

Figure 1:
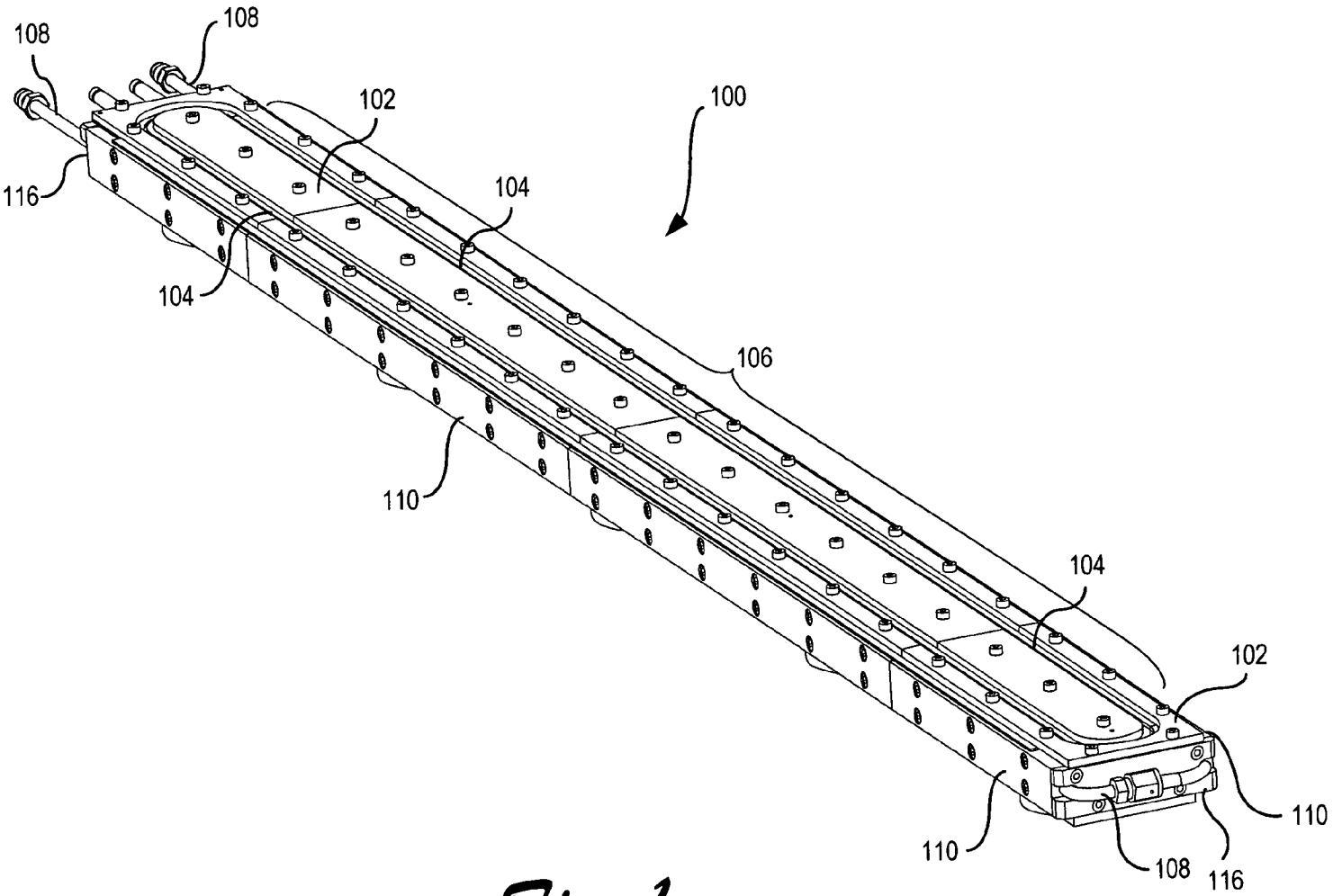
FIG. 1 illustrates an exemplary modular ALS.

FIG. 1 illustrates an exemplary modular ALS 100. Cathode covers 102 are affixed to the ALS 100 to form an opening for a race-track-shaped ionization channel 104. The cathode covers 102 may be monolithic or modular, although the illustrated implementation employs modular cathode covers.

The anode and the cathode of the ALS 100 are located beneath the cathode covers 102. In one implementation, the anode is tied to a high positive potential and the cathode is tied to ground in order to generate the electric field in the anode-cathode gap, although other configurations of equivalent polarity may be employed. A magnetic circuit is established through the source body to the cathodes using permanent magnets to form a magnetic field in the cathode-cathode gap. The interaction of strong crossed electric and magnetic fields in this gap region ionizes the working gas and accelerates the ions in an ion beam from the anode layer toward a target (e.g., toward a substrate). Generally, the target is passed through the portion of the ion beam generated by the longitudinal section 106 of the ALS 100 to maximize the uniformity of the ion beam directed onto the target.

The ALS 100 is manufactured from modular components, although a monolithic ion source may also be employed. To facilitate use of common component modules in ion sources having different lengths, typical substrate widths for various ion beam applications were considered. Some typical substrate widths for web coating and flat glass applications are 1.0 m, 1.5 m, 2.54 m, and 3.21 m. As such, a common source body module length of 560 mm was determined to provide ion sources with suitable beam lengths to cover all of these sizes, in addition to covering a 2.0 m ion source. However, it should be understood that different module lengths may also be employed, and in some applications, the modules lengths may differ substantially within the same modular ion source.

The source body modules are bound together by the clamp plates 110 and other structures in the ALS 100 so as to provide overall rigidity along the length of the ALS 100 (i.e., along the longitudinal axis of the ion source). In addition, a flexible anode, which is less rigid than a traditional rigid monolithic anode, is sufficiently flexible to allow the anode to follow any discontinuities or warpage along the length of the ALS 100, thereby contributing to the uniformity of the anode-cathode gap. End plates 116 close off each end of the ALS 100.

The plasma and the high voltage used to bias the anode of the ALS 100 generate a large amount of heat, which can damage the ion source and undermine the operation of the source. Accordingly, the anode is cooled by a coolant (e.g., water) pumped through a hollow cavity within the anode. Furthermore, a cooling tube 108 assists in cooling the cathode and source body of the ALS 100 by conducting the heat away from the ion source body through a coolant (e.g., water), which is pumped through the cooling tube 108. The cooling tube 108 may be constructed from various materials, including without limitation stainless steel, copper, or mild steel. The clamp plates 110 press the cooling tube 108 against the side of the body of the ALS 100 to provide the thermally conductive contact for cooling the source, without welding or brazing the cooling tube 108 to the ion source body. In at least one implementation, the clamp plates 110 overlap the joints between ion source body modules to provide structural rigidity and alignment force along the length of the ALS 100.

In one implementation, an easily compressible material with high conductivity (such as indium foil) is compressed between the cooling tube 108 and the source body. The material conforms between the source body and the cooling tube 108 to improve heat conduction from the body of the ALS 100 to the coolant, although other heat conducting materials may also be employed, such as flexible graphite.

Alternatively, no added material is required between the cooling tube 108 and the source body. In one implementation, grooves in the source body and the clamp plates 110 are sized to compress the cooling tube 108 with enough force to cold work or deform the tube 108 against the source body, thereby providing an adequate thermally conductive contact to efficiently cool the source body and the cathode.

Figure 2:
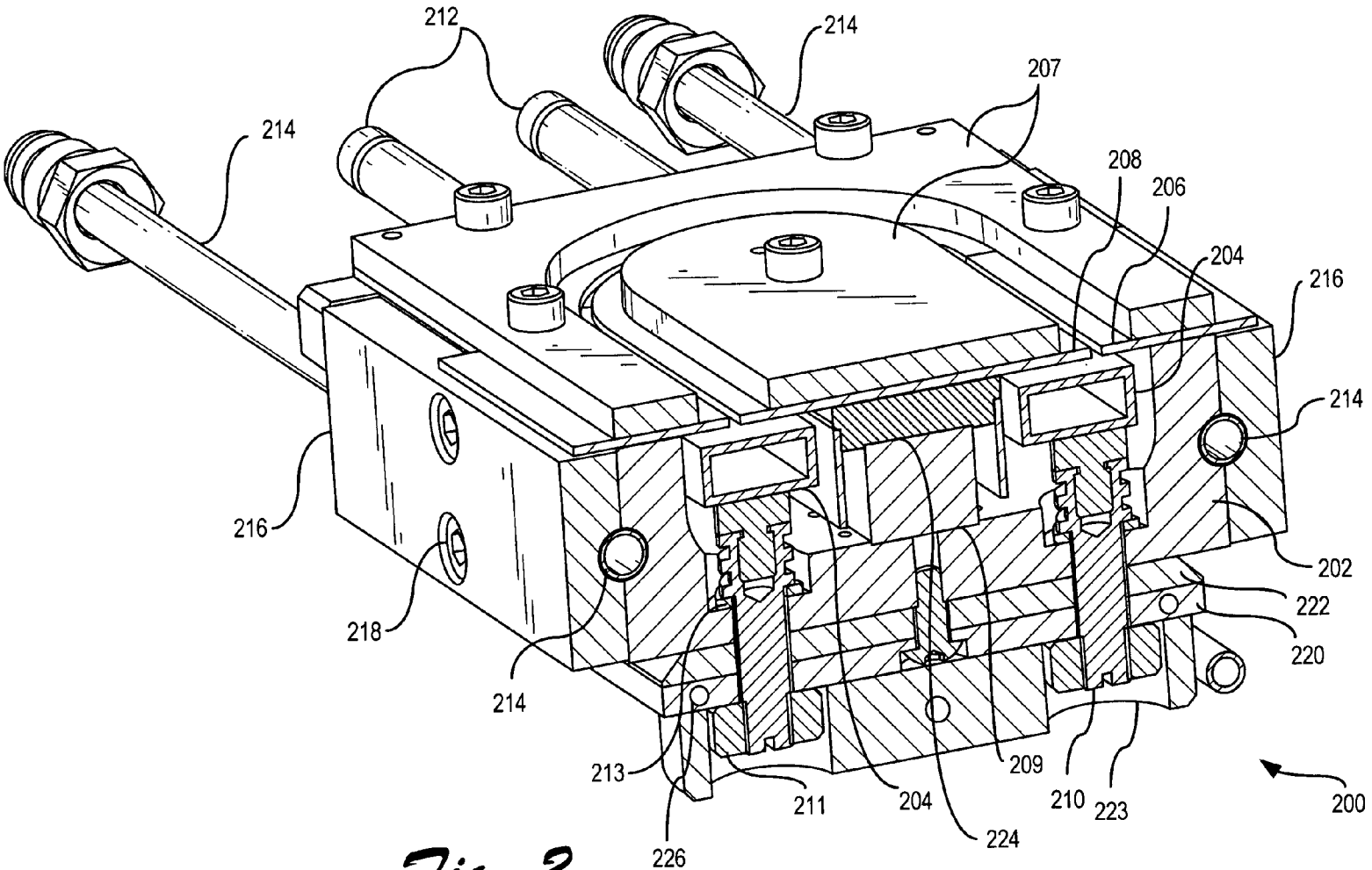
FIG. 2 illustrates a cross-sectional view of an exemplary modular ALS.

FIG. 2 illustrates a cross-sectional view of an exemplary modular ALS 200. An end module of an ion source body 202 of the ALS's body forms a roughly U-shaped cavity in which the anode 204 is located. Additional source body modules (not shown) extend the cavity down the length of the ALS 200.

The two cathode plates 206 and 208 form the cathode of the ALS. The separation between the cathode plates 206 and 208 establishes the cathode-cathode gap. A magnetic circuit is driven by a magnet 209, through the source body module 202, to each of the cathode plates 206 and 208. Cathode covers 207 clamp the cathode plates 206 and 208 to the source body module 202 and magnet covers 224 and define an opening for the race-track-shaped ionization channel.

As shown in FIG. 2, the anode 204 is fabricated from a thin-walled stainless steel tubing in order to provide the desired flexure along the anode's length. Tubing sections are welded together to form a rectangular-shaped anode that lies under the opening at the ionization channel. In one implementation, the tubing is commercially available 300 series thin walled rectangular tubing (0.375"×0.75"×0.060" wall), although other specifications and dimensions are also contemplated, including tubing with a height of 0.125"–0.5", a width of 0.5"–1.0", and a wall thickness of 0.02"–0.09". Accordingly, the anode 204 is comparatively flexible in the Y-axis (i.e., the ion beam axis), so it will easily conform to irregularities along the source body. Furthermore, the tubing walls are thick enough to prevent "ballooning" of the tubing during operation and to prevent overall distortion of the anode's rectangular shape.

The anode 204 is mounted to a series of anode insulator posts 210, which supports the anode 204 at the proper height to achieve the desired uniform anode-cathode gap dimension. The insulator posts 210 are spaced close enough together (e.g., ~<200 mm) along the anode 204 to prevent sagging or distortion of the anode 204. The insulator posts 210 are fixed in place during operation by insulator nuts 211 and precision machined spacers 213. (Note: In some implementations, spacers are not employed because other components are precision machined to achieve the desired anode-cathode gap dimension.) The anode insulator posts 210 may have a fixed height relative to the interior surface of the source body module 202 or the height of the posts 210 can be changed during manufacturing to tune the anode-cathode gap to within a specified tolerance along the length of the ALS 200. Where the posts 210 are adjustable, they are generally fixed after manufacture and during operation.

The anode 204 includes a hollow conduit to allow the flow of anode coolant (e.g., water) provided by anode cooling tubes 212. Another cooling tube 214 is clamped to the source body module 202, as well as the other source body modules in the ALS 200 to provide additional cooling capacity to the source body module 202 and the cathode 206/208. The cooling tube 214 is pressed into thermally conductive contact with the source body modules by clamp plates 216 and clamp screws 218.

A working gas, which is ionized to produce the plasma, is distributed under uniform controlled pressure within the cavity of the source body module 202. A modular gas distribution plate 220, in combination with gas distribution manifolds (such as manifold 223), uniformly distributes the gas into a gas baffle plate 222, which directs the gas through flow holes in the source body module 202. The modular gas distribution plate 220 also includes precision drilled pin holes 226 to facilitate alignment of adjacent modular gas distribution channels along the length of the ALS 200.

Figure 3:
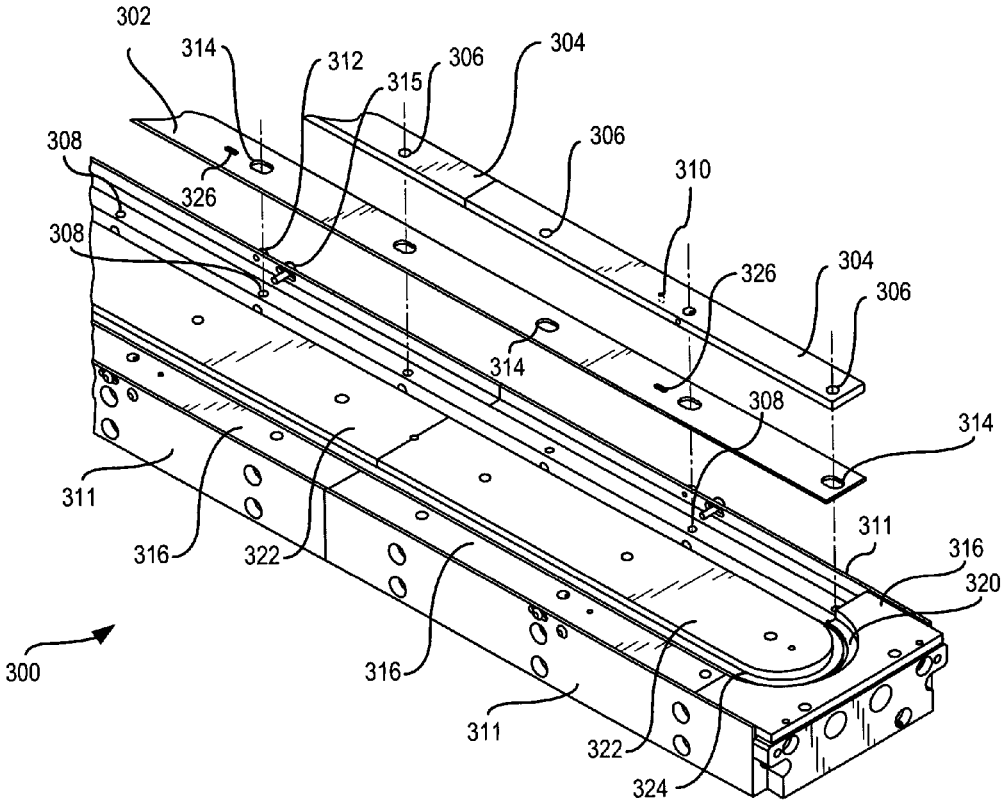
FIG. 3 illustrates an exploded assembly view of an end of a cathode plate configuration of an exemplary ALS allowing longitudinal cathode expansion.

FIG. 3 illustrates an exploded assembly view of an end of a cathode plate configuration of an exemplary ALS 300 allowing longitudinal cathode expansion. The view of the ALS 300 in FIG. 3 includes a rounded end of the "race-track-shaped" ionization channel and two linear sections of the ionization channel extending longitudinally away from the rounded end. The cathode-cathode gap and the anode-cathode gap are located in the ionization channel area.

A cathode plate 302 is positioned on a side wall of the source body of the ALS 300 to provide one edge of the cathode-cathode gap in the ion source. The cathode plate 302 is formed as a long rectangular strip. In some implementations, the cathode plate 302 may be fabricated from strips of sheet material with uniform thickness. An exemplary thickness is 1.5 mm thick magnetic steel or stainless steel, although other thicknesses and materials are also contemplated. The cathode plate 302 includes two long symmetrical edges, wherein either edge is capable of being used as a working edge of the cathode-cathode gap. The cathode edge may also have some chamfer, radius, or other profile to improve operating performance.

As such, when one edge wears to an un-desirable profile, it is no longer usable to provide a uniform ion beam (e.g., the cathode-cathode gap is out of tolerance or too uneven), the cathode plate 302 can be removed, flipped over, and remounted to the source body wall, thereby providing an unworn cathode working edge for subsequent operation.

A cathode cover 304 secures the cathode plate 302 against the source body wall. The cathode cover 304 includes enlarged or laterally slotted attachment holes 306 through which fasteners, such as screws, may be inserted to anchor the cathode cover 304 to the source body wall. The enlarged holes or lateral slots 306 in the cathode cover 304 allow lateral adjustment of the cathode cover 304 and therefore the cathode plate 302, as discussed later. The corresponding attachment holes in the source body wall are shown at 308. The cathode plate 302 is positioned between the cathode cover 304 and the source body wall. Each fastener is tightened to press the cathode plate 302 securely against the source body wall, while allowing longitudinal expansion of the cathode plate 302. Enlarged slots 314 in the cathode plate 302 allow the fastener to be inserted through the cathode plate without substantially constraining longitudinal expansion of the cathode plate.

A clamp plate 311 is secured to the ALS 300, and in some implementations, the clamp plate 311 contributes to longitudinal rigidity of a modular ion source. In addition, the clamp plate 311 may be used to press a cooling tube (not shown) against the source body of the ion source to cool the source body and the cathode of the ion source. However, in the illustrated implementation, the clamp plate 311 also acts as an anchor for pull screw 315 and push screw 312, which assist in setting the lateral position of the cathode plate 302. The pull screw 315 is inserted into a tapped hole in the cathode cover to pull the cathode plate edge, thereby increasing the cathode-cathode gap dimension. The push screw 312 is threaded through a tapped hole in the clamp plate or source body and adjusted inward to decrease the cathode-cathode gap dimension. Used in tandem, the screws 312 and 315 can be used to set the specified cathode-cathode gap dimension within tolerance along the length of the ion source and lock the cathode assembly into place.

The cathode cover 304 also includes a fixed pin 310 extending from the cathode cover 304 toward the source body wall. The pin 310 is inserted into a longitudinal slot 326 of the cathode plate 302, which has its long axis aligned with the longitudinal axis of the ion source. The clearance of slot 326, however, is tight enough in the lateral direction (e.g., <0.05 mm in one implementation) to effectively constrain lateral movement of the cathode plate 302 relative to the cathode cover 304. Because the lateral position of the cathode cover 304 is adjustably fixed by the push/pull pin combinations, the cathode-cathode gap is also adjustably fixed.

Other cathode covers 316 are shown over a linear cathode plate on the long near side of FIG. 3 and an end cathode plate 320. Yet another cathode cover 322 is shown over an inner cathode plate 324, supported by a magnet cover in the "infield" of the race-track-shaped cathode-cathode gap.

Figure 4:
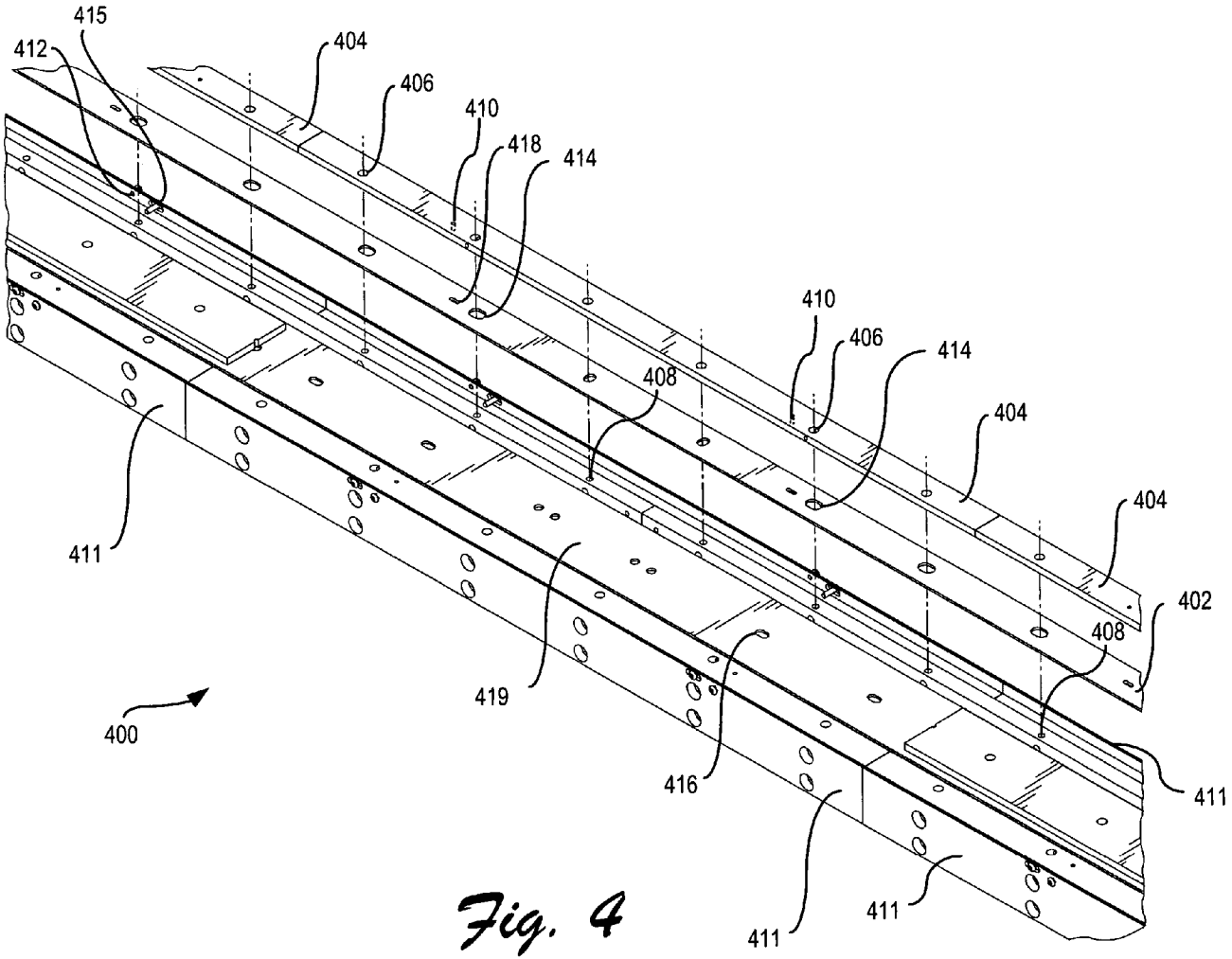
FIG. 4 illustrates an exploded assembly view of an interior section of a cathode plate configuration of an exemplary ALS allowing longitudinal cathode expansion.

FIG. 4 illustrates an exploded assembly view of an interior section of a cathode plate configuration of an exemplary ALS allowing longitudinal cathode expansion. A cathode plate 402 is positioned on a wall of the source body of the ALS 400 to provide one working edge of the cathode-cathode gap in the ion source.

A cathode cover 404 secures the cathode plate 402 against the source body wall. The cathode cover 404 includes enlarged or laterally slotted attachment holes 406 through which fasteners, such as screws, may be inserted to anchor the cathode cover 404 to the source body wall. The corresponding attachment holes in the source body wall are shown at 408. The cathode plate 402 is positioned between the cathode cover 404 and the source body wall. Each fastener is tightened to press the cathode plate 402 securely against the source body wall, while allowing longitudinal expansion of the cathode plate 402. Enlarged slots 414 in the cathode plate 402 allow the fastener to be inserted through the cathode plate without substantially constraining longitudinal expansion of the cathode plate.

A clamp plate 411 is secured to the ALS 400, and in some implementations, the clamp plate 411 contributes to longitudinal rigidity of a modular ion source. In addition, the clamp plate 411 may be used to press a cooling tube (not shown) against the source body of the ion source to cool the source body and the cathode of the ion source. However, in the illustrated implementation, the clamp plate 411 also acts as an anchor for pull screw 415 and push screw 412, which assist in setting the lateral position of the cathode plate 402.

The cathode cover 404 also includes one or more fixed pins 410 extending from the cathode cover 404 toward the source body wall. The pin 410 is inserted into a longitudinal slot 418 of the cathode plate 402, which has its long axis aligned with the longitudinal axis of the ion source. The clearance of slot 418, however, is tight enough in the lateral direction (e.g., <0.05 mm in one implementation) to effectively constrain lateral movement of the cathode plate 402 relative to the cathode cover 404.

FIG. 4 also depicts and exposed inner cathode plate 419, which also includes longitudinally slotted attachment holes 416. An inner cathode cover, which may or may not be modular, is positioned on the inner cathode plate 419 to secure the inner cathode plate 419 to an underlying series of magnet covers in the center of the source body cavity. The inner cathode cover is secured to the magnet cover by attachment screws, which are inserted through attachment holes in the cathode cover and the slotted attachment holes 416 in the cathode plate 419, and into attachment holes (not shown) in the magnet cover. The slotted attachment holes 416 allow the inner cathode plate 419 to expand longitudinally during operation to relieve the strain of differential thermal expansion in the cathode plate 419. In addition, the attachment screws and the slotted attachment holes 416 constrain lateral movement of the inner cathode plate 419 while allowing longitudinal expansion.

Figure 5:
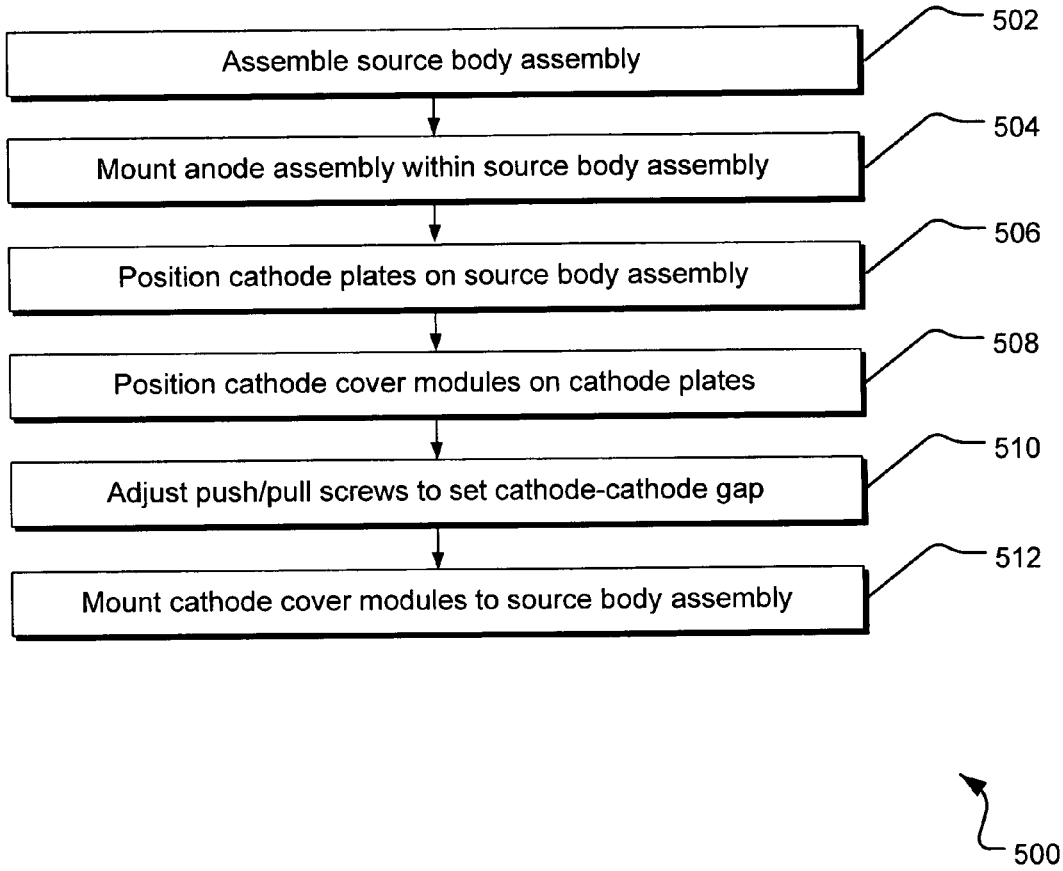
FIG. 5 illustrates exemplary operations for manufacturing an ALS that allows longitudinal cathode expansion.

FIG. 5 illustrates exemplary operations 500 for manufacturing an ALS that allows longitudinal cathode expansion. An assembly operation 502 builds a source body assembly, which may include a monolithic source body or a plurality of source body modules. An exemplary source body assembly is shown in FIGS. 1 and 2, in combination with an anode assembly and other components of an ion source. The source body assembly forms a roughly U-shaped cavity that encompasses a plurality of magnets and a plurality of magnet cover modules. A mounting operation 504 installs an anode assembly, including an anode mounted on insulator posts, within the cavity of the source body assembly.

A positioning operation 506 positions two or more cathode plates on the source body assembly. For example, an inner cathode plate is positioned on a sequence of magnet covers in the center of the source body assembly cavity, and an outer cathode, which may or may not be modular, is positioned on the source body walls. Another positioning operation 508 positions cathode cover modules on the cathode plates, aligning the attachment holes in both types of components and inserting the fixed pin of the cathode cover into a longitudinal slot in the cathode plate. An adjustment operation 510 adjusts the initial cathode-cathode gap using the push screw and the pull screw. A securing operation 512 secures the cathode cover modules to the source body assembly using a series of fasteners, such as screws, inserted through the attachment holes of the cathode cover and cathode plate into the source body assembly, thereby fixing the cathode-cathode gap within acceptable tolerances.

Figure 6:
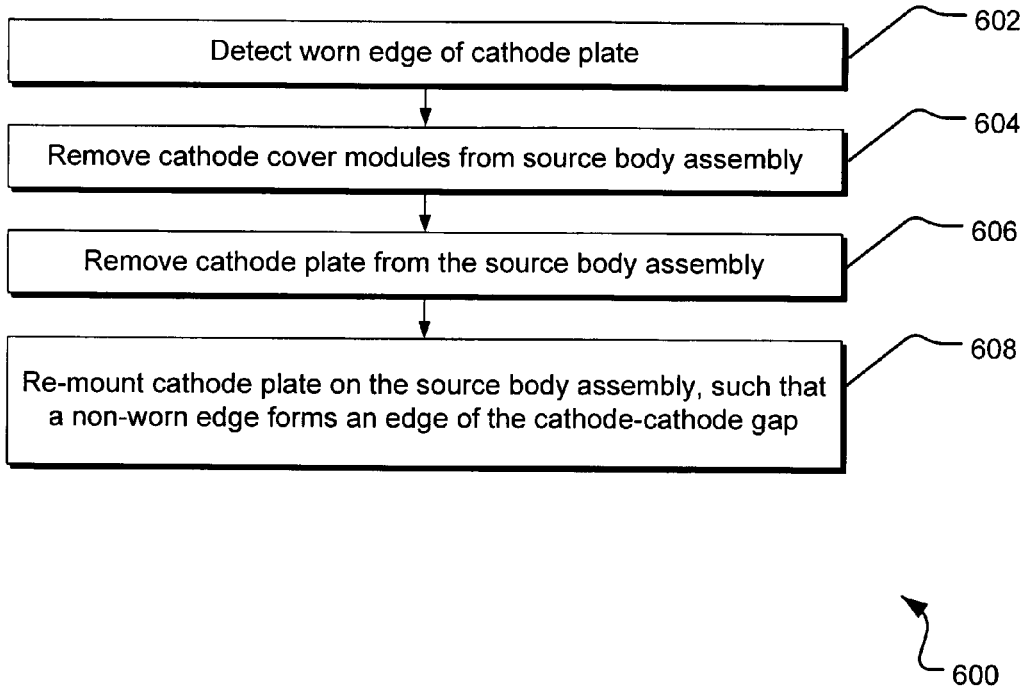
FIG. 6 illustrates exemplary operations for flipping an edge of a cathode plate in an ALS.

FIG. 6 illustrates exemplary operations 600 for flipping an edge of a cathode plate in an ALS. The cathode plate is fabricated to have two symmetrical edges capable of performing as a working edge of a cathode-cathode gap. A detection operation 602 detects a worn edge of a cathode plate in the cathode-cathode gap region. The worn edge causes the cathode-cathode gap dimension to exceed an acceptable tolerance, thereby degrading the ion beam performance. Such detection may include without limitation monitoring the ion beam for decreased performance and checking the gap using a precision machined shim or jig, which can be place between the cathodes in the channel to measure the gap.

A removal operation 604 removes the cathode cover modules that secure the worn cathode plate against the source body walls. Another removal operation 606 removes the worn cathode plate from the source body wall. A re-mounting operation 608 flips the worn cathode plate over (e.g., rotating the cathode plate about its longitudinal axis) to expose the second unworn edge of the cathode plate into the cathode-cathode gap, thereby extending the life of the cathode plate.

Figure 7:
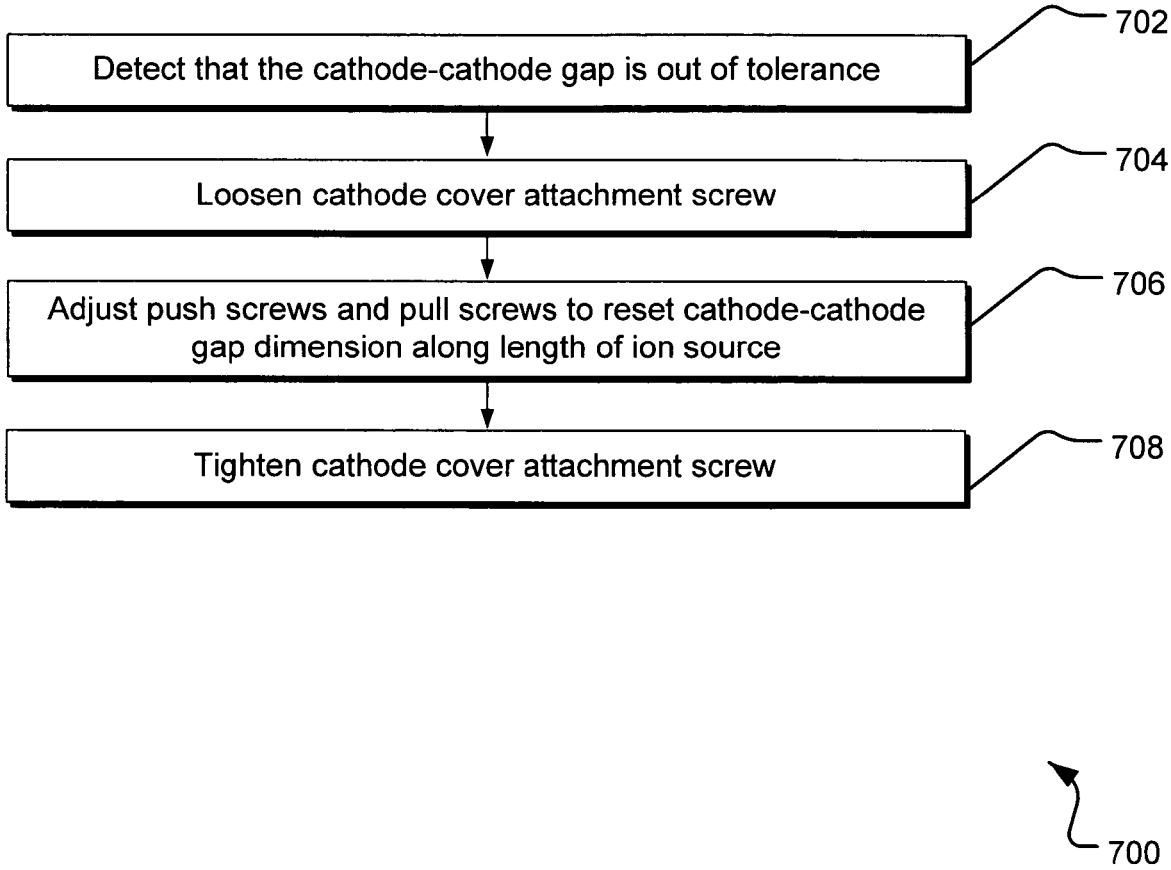
FIG. 7 illustrates exemplary operations for adjusting an edge of a cathode plate in an ALS.

FIG. 7 illustrates exemplary operations 700 for adjusting an edge of a cathode plate in an ALS. A detection operation 702 detects a worn working edge of a cathode plate in the cathode-cathode gap region. The worn edge causes the cathode-cathode gap dimension to exceed an acceptable tolerance, thereby degrading the ion beam performance.

A loosening operation 704 loosens cathode cover attachment screws to allow some lateral movement of the cathode cover modules, and therefore, the cathode plates. An adjustment operation 706 adjusts the push/pull screws that are anchored to the clamp plates of the ion source (or to some other anchor in the ion source). The adjustment resets the cathode-cathode gap to within a specified tolerance along the length of the ion source. In one implementation, the cathode plate is adjusted until it rests against a precision machined shim or jig inserted at various locations along the longitudinal axis of the gap. A tightening operation 708 tightens the cathode cover attachment screws to re-secure the cathode cover and the cathode plate to the source body assembly.

The above specification, examples and data provide a complete description of the structure and use of exemplary implementations of the described articles of manufacture and methods. Since many implementations can be made without departing from the spirit and scope of the invention, the invention resides in the claims hereinafter appended.

Furthermore, certain operations in the methods described above must naturally precede others for the described method to function as described. However, the described methods are not limited to the order of operations described if such order sequence does not alter the functionality of the method. That is, it is recognized that some operations may be performed before or after other operations without departing from the scope and spirit of the claims.

What is claimed is:

1. An ion source having a source body, the ion source comprising:

a cathode plate having a working edge positioned along a side of a cathode-cathode gap; and a cathode cover securing the cathode plate against the source body.

2. The ion source of claim 1 wherein the ion source is an anode layer source.

3. The ion source of claim 1 wherein the cathode cover secures the cathode plate to substantially prohibit lateral movement of the cathode plate while allowing longitudinal expansion of the cathode plate.

4. The ion source of claim 1 wherein the cathode plate includes an elongated pin slot and the cathode cover includes a pin, the long axis of the elongated pin slot being oriented along the longitudinal axis of the cathode plate, the pin being inserted into the elongated pin slot of the cathode plate.

5. The ion source of claim 1 wherein the cathode plate includes an elongated fastener hole, the long axis of the elongated fastener hole being oriented along the longitudinal axis of the cathode plate, the cathode plate being secured to the source body by a fastener inserted through the cathode cover and the elongated fastener hole of the cathode plate and into the source body.

6. The ion source of claim 1 further comprising:

an anchor fixed to the source body; and an adjustable push screw attached to the anchor surface and contacting the cathode cover, the push screw setting the lateral position of the cathode cover and the cathode plate relative to the cathode-cathode gap.

7. The ion source of claim 1 further comprising:

an anchor fixed to the source body; and an adjustable pull screw inserted through the anchor surface and anchoring to the cathode cover, the pull screw setting the lateral position of the cathode cover and the cathode plate relative to the cathode-cathode gap.

8. The ion source of claim 1 wherein the source body comprises a plurality of source body modules.

9. The ion source of claim 1 wherein the cathode cover comprises a plurality of cathode cover modules.

10. The ion source of claim 1 wherein the ion source includes a linear section and the cathode plate extends the length of the linear section forming a closed path in the ion source with at least one other cathode plate.

11. The ion source of claim 1 wherein the cathode plate includes two symmetrical edges, such that both edges of the cathode plate operate as the working edge of the cathode-cathode gap.

12. A method of assembling an ion source, the method comprising:

assembling a source body assembly;

mounting an anode assembly with the source body assembly;

positioning two or more cathode plates relative to the anode assembly to form an anode-cathode gap and a cathode-cathode gap, at least one of the cathode plates forming the outside edge of the cathode-cathode gap and including one or more elongated pin slots and one or more enlarged attachment holes;

inserting a pin of a cathode cover into one of the elongated pin slots of the at least one of the cathode plates; and mounting the cathode cover to the source body assembly using a fastener inserted through one of the enlarged attachment holes of the cathode and into the source body assembly.

13. A method of assembling an anode layer source having a source body, the method comprising:

securing a cathode plate against the source body using a cathode cover, the cathode plate having a working edge positioned along a side of a cathode-cathode gap in the anode layer source.

14. The method of claim 13 wherein the cathode plate has two symmetrical edges capable of being used as the working edge positioned along the side of the cathode-cathode gap.

15. A method of maintaining an ion source, the method comprising:

removing a cathode cover from an source assembly including at least one cathode plate having a worn edge and an unworn edge, the worn edge being worn as an edge of a cathode-cathode gap in the ion source during operation of the ion source;

removing the cathode plate from the ion source assembly; and re-mounting the cathode plate to the ion source assembly such that the unworn edge forms the edge of the cathode-cathode gap in the ion source.

16. A method of maintaining an ion source having a cathode plate positioned against a source body the method comprising:

loosening attachment fasteners securing a cathode cover module and the cathode plate to the source body, the cathode cover module being in laterally fixed alignment with the cathode plate;

adjusting one or more adjustable screws positioned along the length of the cathode cover to reset a specified cathode-cathode gap dimension in the ion source; and tightening the attachment fasteners to re-secure the cathode cover module and the cathode plate to the source body.

* * * * *